US012146304B2

(12) United States Patent
Chen et al.

(10) Patent No.: US 12,146,304 B2
(45) Date of Patent: Nov. 19, 2024

(54) SENSING FAUCET BASED ON ACCELERATION SENSOR

(71) Applicant: Fuzhou Rajeyn Electronic Science Technology Co., Ltd., Fujian (CN)

(72) Inventors: Junmin Chen, Fujian (CN); Shijie Peng, Fujian (CN); Yongshan Chen, Fujian (CN)

(73) Assignee: Fuzhou Rajeyn Electronic Science Technology Co., Ltd., Fujian (CN)

( * ) Notice: Subject to any disclaimer, the term of this patent is extended or adjusted under 35 U.S.C. 154(b) by 94 days.

(21) Appl. No.: 17/968,078

(22) Filed: Oct. 18, 2022

(65) Prior Publication Data

US 2024/0060281 A1 Feb. 22, 2024

(30) Foreign Application Priority Data

Aug. 18, 2022 (CN) ..... 202222182710.3

(51) Int. Cl.
*E03C 1/04* (2006.01)
*E03C 1/05* (2006.01)

(52) U.S. Cl.
CPC ..... *E03C 1/0404* (2013.01); *E03C 1/055* (2013.01); *E03C 2001/0415* (2013.01)

(58) Field of Classification Search
CPC . E03C 1/0404; E03C 1/055; E03C 2001/0415
USPC ..... 137/801
See application file for complete search history.

(56) References Cited

U.S. PATENT DOCUMENTS 6,093,313 A * 7/2000 Bovaird ..... B01D 35/04 137/551
8,365,767 B2 * 2/2013 Davidson ..... G05D 23/1393 137/559
9,783,964 B2 * 10/2017 Thompson ..... G05D 23/1393
2007/0246564 A1 * 10/2007 Rodenbeck ..... E03C 1/0404 239/588
2014/0352799 A1 * 12/2014 Rosko ..... C02F 1/78 137/237
2018/0216324 A1 * 8/2018 Beck ..... E03C 1/055
2019/0063049 A1 * 2/2019 Wang ..... F16K 37/0033

FOREIGN PATENT DOCUMENTS

CN 215059841 U 12/2021

* cited by examiner

*Primary Examiner* — Patrick C Williams

(74) *Attorney, Agent, or Firm* — Cooper Legal Group, LLC

(57) ABSTRACT

The present disclosure discloses an acceleration sensor-based sensing faucet, including a faucet body, an automatic water outlet control unit, and a sensing module. The faucet body has a movable water outlet end, the sensing module includes a mounting seat, the acceleration sensor, a power source, and a communication unit. The acceleration sensor, the power source and the communication unit are all provided on the mounting seat, and the mounting seat is removably provided at the water outlet end. The power source supplies power to the acceleration sensor and the communication unit, the acceleration sensor is electrically connected to the communication unit. The communication unit is connected in communication with the automatic water outlet control unit, and the automatic water outlet control unit is configured for controlling water outlet states of the water outlet end. The present disclosure has a compact structure, it is convenient for production, assembly, and subsequent maintenance.

13 Claims, 8 Drawing Sheets

SENSING FAUCET BASED ON ACCELERATION SENSOR

CROSS-REFERENCE TO RELATED APPLICATION

The present disclosure claims priority to Chinese Patent Application 202222182710.3, filed on Aug. 18, 2022, which is incorporated herein by reference.

TECHNICAL FIELD

The present disclosure relates to the technical field of faucets, and in particular, to an acceleration sensor-based sensing faucet.

BACKGROUND

As a necessary equipment for daily production and domestic water, faucets are widely used in kitchens, bathrooms and other places. The pull-out faucet is widely used because its pull-out head (usually a shower) can be pulled out to different positions to meet the water needs of different positions and is convenient to use.

For the convenience of use, most of the existing pull-out faucets are equipped with a pull-out sensing device to realize automatic water-on when the pull-out head is pulled out, and automatic water-off when the pull-out head is reset. However, in most of the existing pull-out sensing faucets, the water will be tuned on as soon as the pull-out head is pulled out, and the water will be turned off after the pull-out head is reset. During pulling, water is easily scattered everywhere, which affects the user experience and is not conducive to the problem of water saving. Published patent CN215059841U discloses a three-axis acceleration sensing pull-out faucet, it can better solve the above problems, but its structure design is not reasonable and compact enough, which is inconvenient for production, assembly and subsequent maintenance

SUMMARY

The object of the present disclosure is to provide an acceleration sensor-based sensing faucet, which can overcome the above-mentioned defects and avoid that the water is turned on as soon as the pull-out head of the pulling faucet is pulled out, and turned off after the pull-out head is reset, causing the water to be easily scattered everywhere. The structure is reasonable and compact, which is convenient for production, assembly, and subsequent maintenance.

In order to achieve the above object, the solution of the present disclosure is:

an acceleration sensor-based sensing faucet, comprising a faucet body, an automatic water outlet control unit and a sensing module; the faucet body has a movable water outlet end, the sensing module comprises a mounting seat, the acceleration sensor, a power source and a communication unit; the acceleration sensor, the power source and the communication unit are all provided on the mounting seat, and the mounting seat is removably provided at the water outlet end; the power source supplies power to the acceleration sensor and the communication unit, the acceleration sensor is electrically connected to the communication unit, and the communication unit is connected in communication with the automatic water outlet control unit, and the automatic water outlet control unit is configured for controlling water outlet states of the water outlet end.

In an embodiment, the water outlet end is a pull-out head, further comprises a pull-out hose; the pull-out hose is movably provided in the faucet body, the pull-out head is connected with the water outlet end of the pull-out hose, and a water inlet end of the pull-out hose is connected to a water outlet end of the automatic water outlet control unit.

In an embodiment, the acceleration sensor is a three-axis acceleration sensor.

In an embodiment, the mounting seat is provided with a first mounting cavity with an opening, an inner wall of the first mounting cavity is provided with a card slot, and the acceleration sensor is clipped in the card slot, such as to be mounted in the first mounting cavity.

In an embodiment, the first mounting cavity is sealed by gluing.

In an embodiment, the communication unit is a wireless communication unit, and the wireless communication unit is fixed on the three-axis acceleration sensor, and an outgoing direction of the wireless signal is toward a direction of a water outlet panel of the pull-out head, the water outlet panel is made of plastic material.

In an embodiment, the power source is a battery, the mounting seat is provided with a battery compartment, and the battery is mounted in the battery compartment.

In an embodiment, the sensing module further comprises sensors, the mounting seat is provided with a second mounting cavity with an opening, and the sensors are provided in the second mounting cavity; the sensors are electrically connected with the communication unit, and the sensors are powered by the power source.

In an embodiment, each of the sensors is an infrared sensor.

In an embodiment, the sensors comprise a first sensor and a second sensor; a sensing direction of the first sensor is toward a side of the pull-out head, and a sensing direction of the second sensor is toward a water outlet direction of the pull-out head.

After adopting the above scheme, the advantageous effect of the present disclosure is that the present disclosure can avoid the water coming out as soon as the pull-out head is pulled out, and the water is turned off after the pull-out head is reset, resulting the water easy to be scattered everywhere, which affects the use experience and is not conducive to water saving. The present disclosure can be easy to use, improve user experience, and is compact structure, convenient for production, assembly, and subsequent maintenance.

Figure 1:
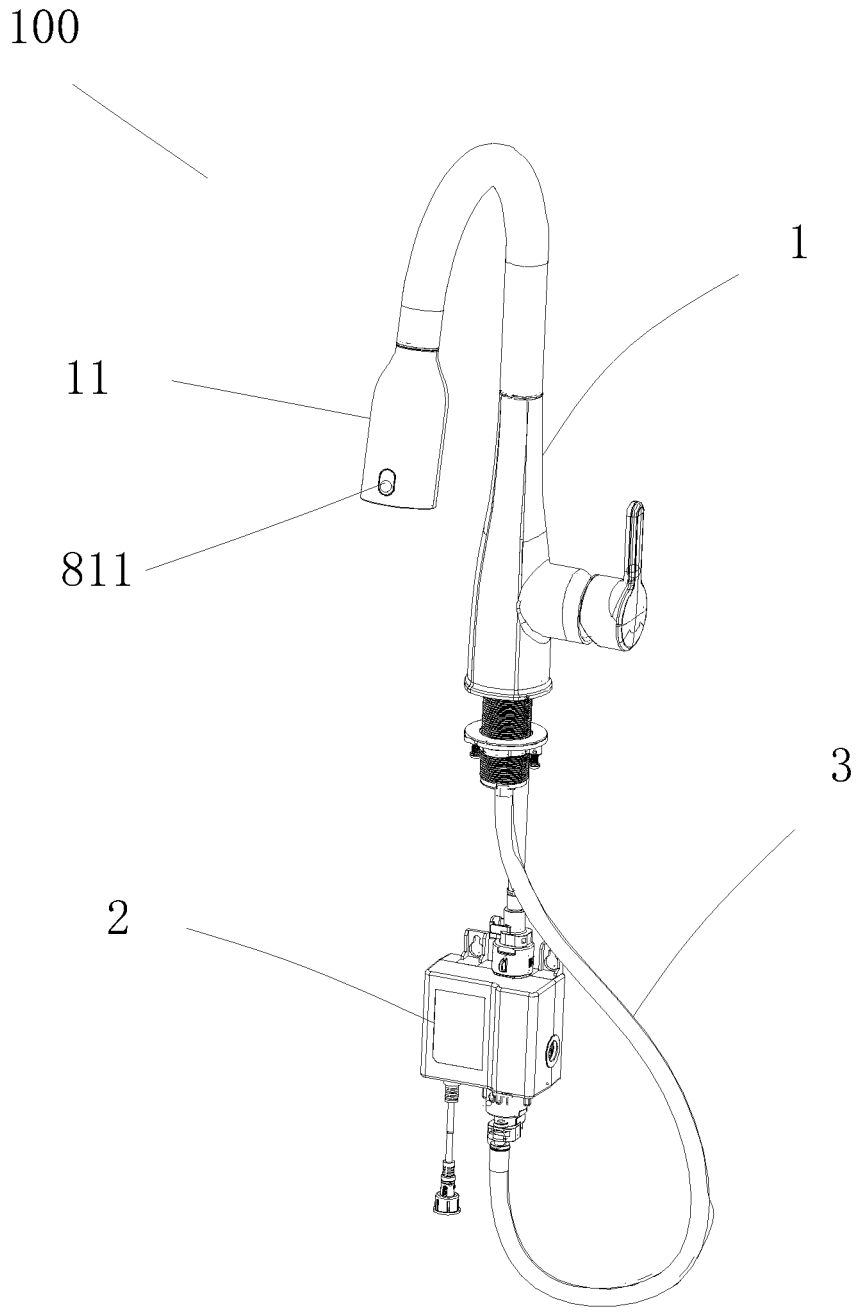
FIG. 1 is a structural diagram of a specific embodiment according to the present disclosure.

Reference numerals' note:

100—sensing faucet, 1—faucet body, 11—pull-out head, 111—housing, 112—screw, 113—water outlet panel;

2—automatic water outlet control unit; 3—pull-out hose;

4—mounting seat, 41—battery compartment, 42—first mounting cavity, 43—second mounting cavity, 421—card slot;

5—acceleration sensor; 6—power source, 61—battery, 7—communication unit, 71—wireless communication unit, 8—sensor, 81—first sensor, 811—sensing window, 812—circuit board, 813—infrared emission tube, 814—infrared receiver tube, 815—light barrier, 816—shell, 82—second sensor.

DESCRIPTION OF EMBODIMENTS

The present disclosure will be described in detail below with reference to the accompanying drawings and specific embodiments.

Figure 2:
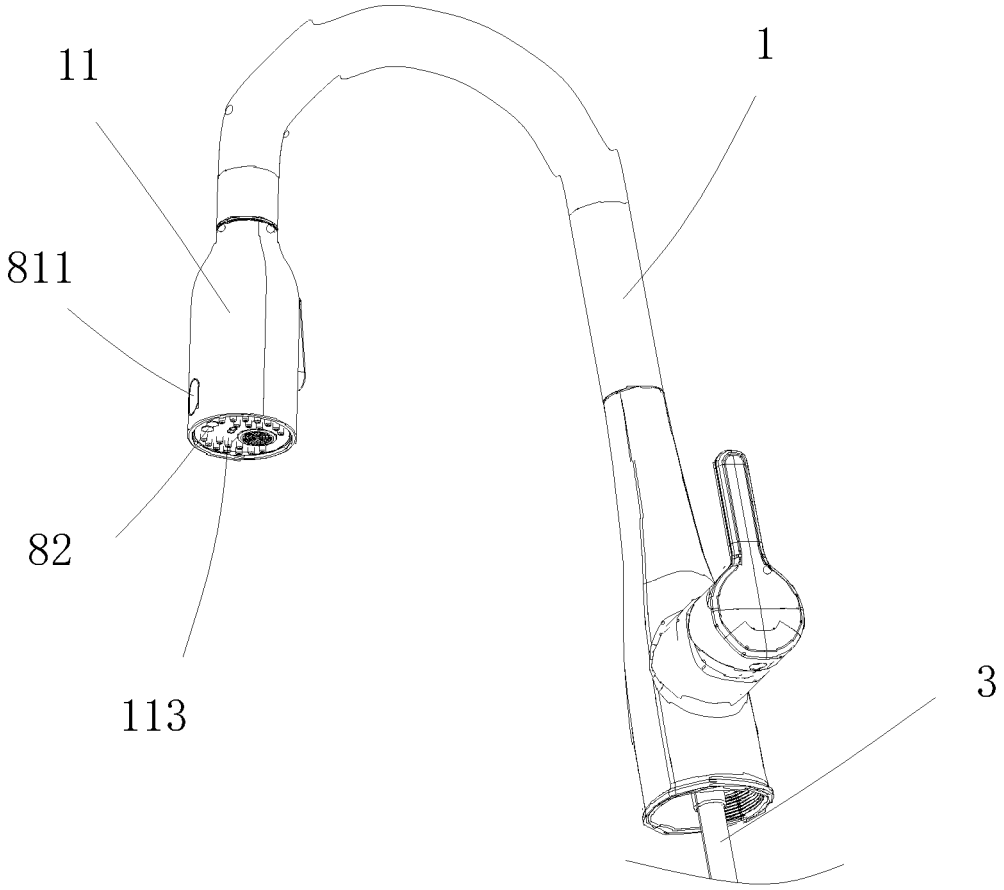
FIG. 2 is a partial structural diagram of a specific embodiment according to the present disclosure.
Figure 3:
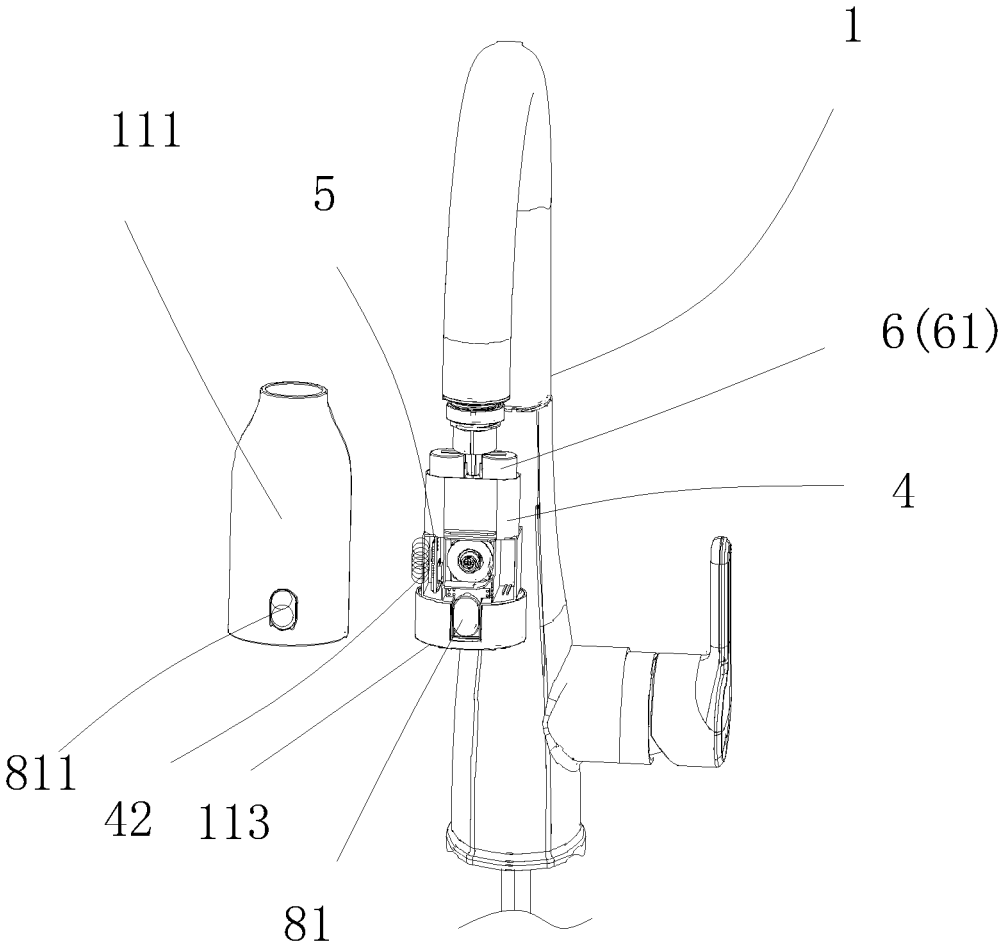
FIG. 3 is a partial exploded view of a specific embodiment according to the present disclosure.
Figure 4:
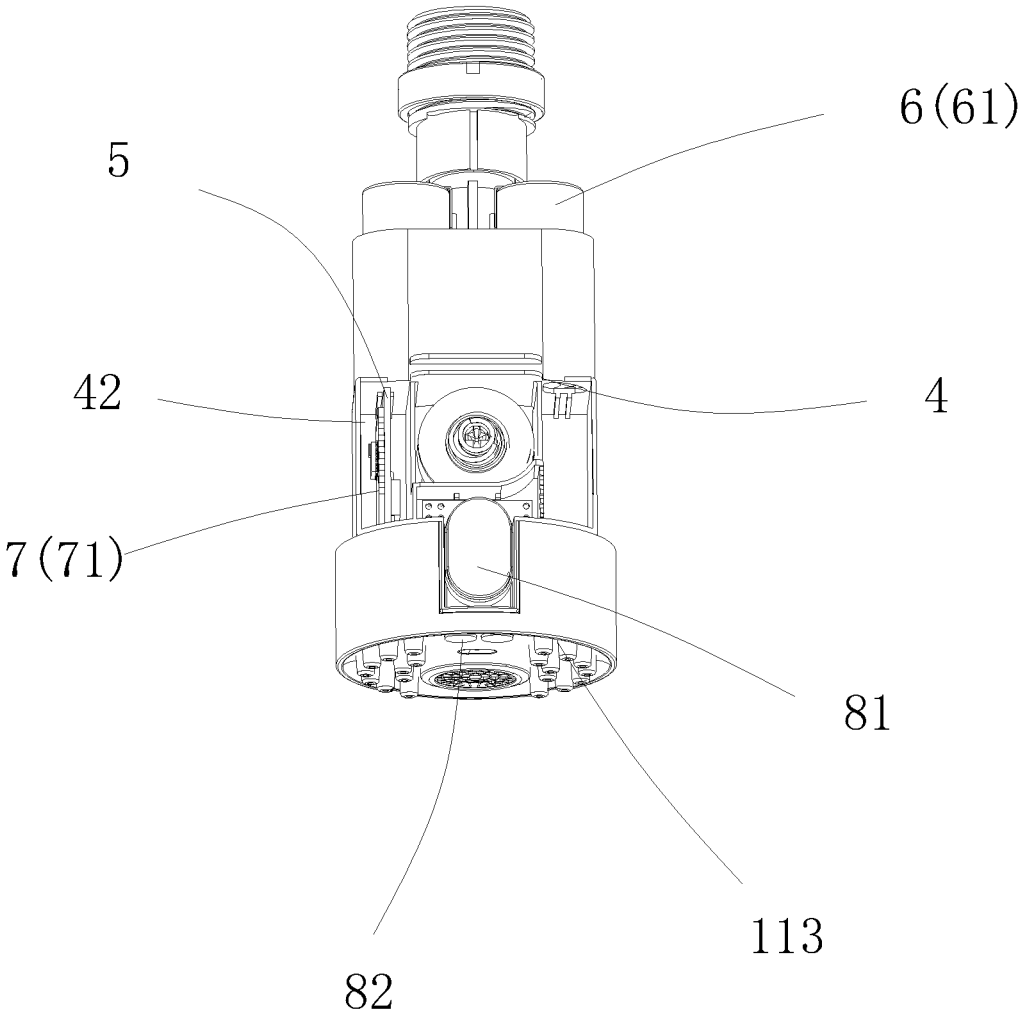
FIG. 4 is a structural diagram of a pull-out head omitting a housing according to a specific embodiment of the present disclosure.
Figure 5:
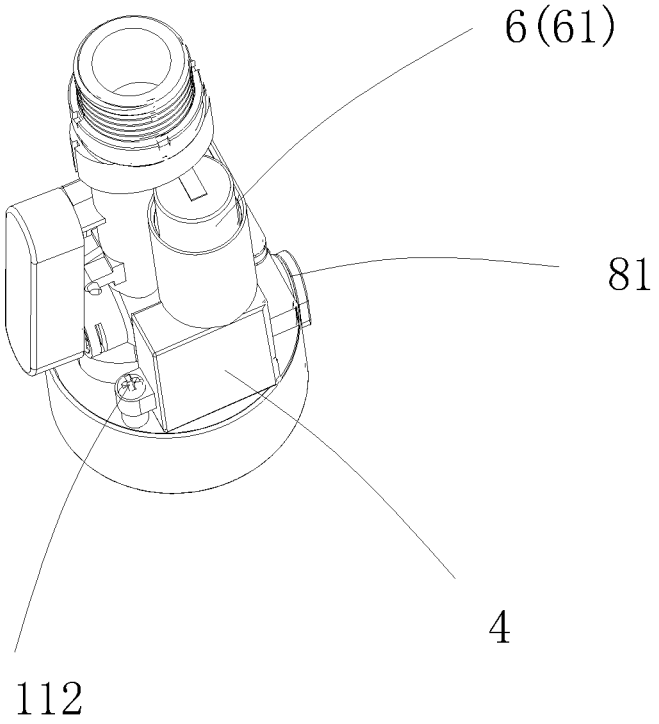
FIG. 5 is a structural diagram of another perspective view of the pull-out head omitting the housing according to a specific embodiment of the present disclosure.
Figure 6:
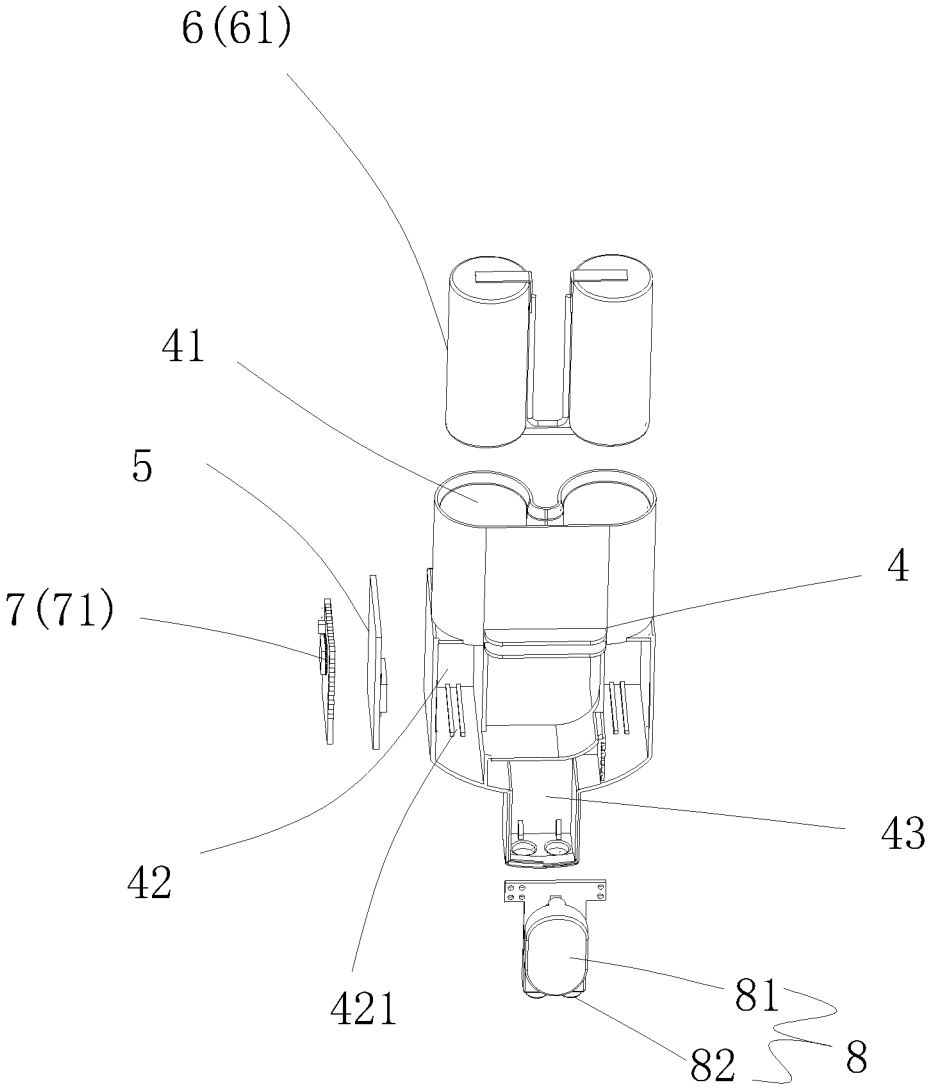
FIG. 6 is an exploded view of a sensing module according to a specific embodiment of the present disclosure.
Figure 7:
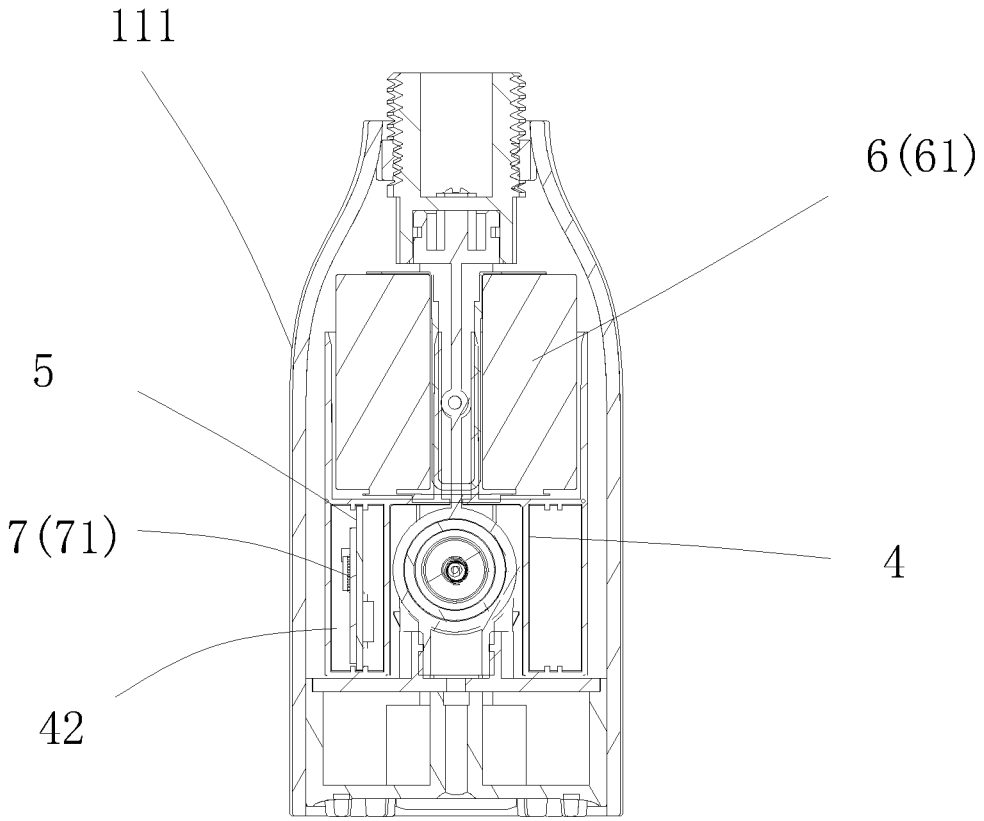
FIG. 7 is a cross-sectional view of a pull-out head according to a specific embodiment of the present disclosure.
Figure 8:
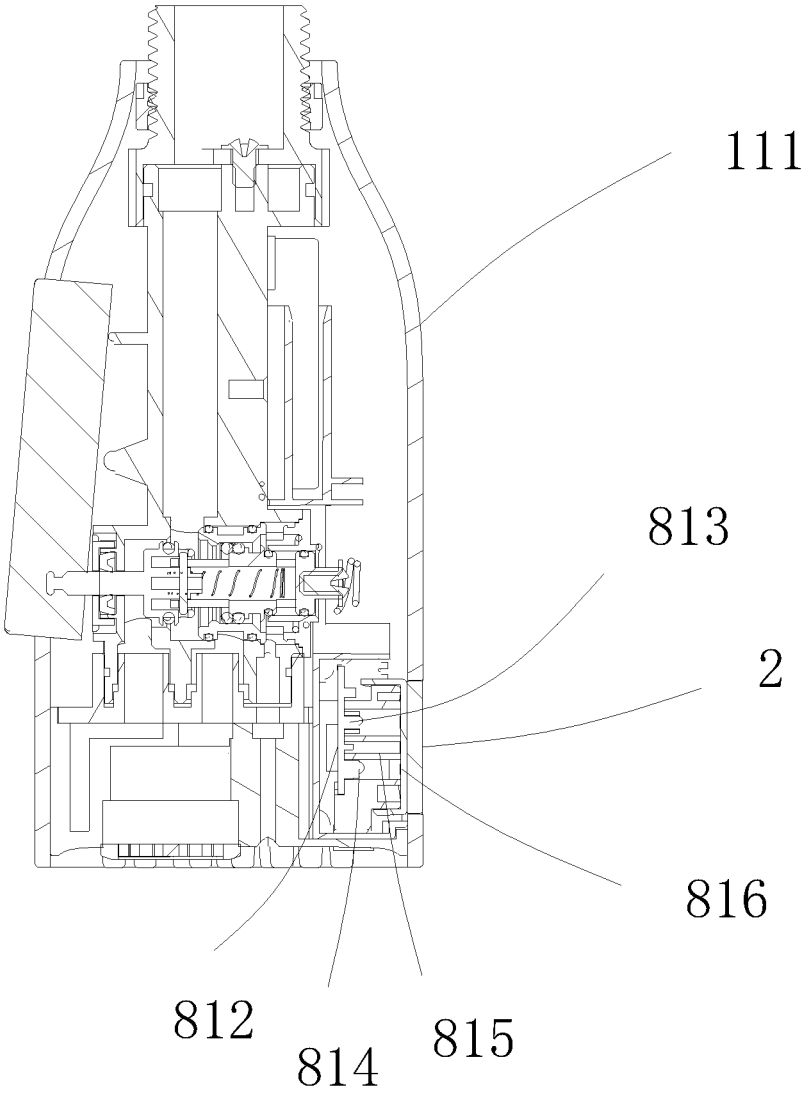
FIG. 8 is another cross-sectional view of the pull-out head according to a specific embodiment of the present disclosure.

As shown in FIGS. 1-8, the present disclosure provides an acceleration sensor-based sensing faucet 100, comprising a faucet body 1, an automatic water outlet control unit 2 and a sensing module. The faucet body 1 has a movable water outlet end. In the specific embodiment, the faucet body 1 may be a pull-out faucet, the water outlet end may be a pull-out head 11, and may also include a pull-out hose 3. The pull-out hose 3 can be movably provided in the faucet body 1, and the pull-out head 11 may be connected to the water outlet end of the pull-out hose 3, and the water inlet end of the pull-out hose 3 may be connected with the water outlet end of the automatic water outlet control unit 2. For a more specific structure, reference may be made to the structure of the existing pull-out faucet, which can be easily realized by those skilled in the art, and will not be described in detail.

The automatic water outlet control unit 2 is used to control the water outlet states of the pull-out head 11. In the specific embodiment, the automatic water outlet control unit 2 is used to control water on/off states of the pull-out head 11, but not limited thereto. In some embodiments, the automatic water outlet control unit 2 may also be used to change the water outlet volume of the pull-out head 11 and the like.

The automatic water outlet control unit 2 may be specifically a control box. The control box may be provided with a control circuit board and a solenoid valve. The control circuit board may be used to control the on-off state of the solenoid valve. The water outlet end of the solenoid valve may be connected to the water inlet end of the pull-out hose 3, and the water inlet end of the solenoid valve may be connected to the water inlet pipeline. For a more specific structure, reference can be made to the structure of the control box of the existing sensing faucet, which can be easily realized by those skilled in the art and will not be described in detail. The control circuit board may be provided with communication unit configured for connecting with the sensing module in communication.

The sensing module may include a mounting seat 4, an acceleration sensor 5, a power source 6, and a communication unit 7. The acceleration sensor 5, the power source 6 and the communication unit 7 may be all provided on the mounting seat 4, and the mounting seat 4 may be removably provided in the pull-out head 11. The power source 6 supplies power to the acceleration sensor 5 and the communication unit 7. In the specific embodiment, the power source 6 may be realized by a battery 61, such as an alkaline dry battery, a rechargeable lithium battery, a button battery, etc., which is easy to implement, low in cost and small in size, but not limited to this. In some embodiments, the power source 6 can also be implemented by using other existing power supplies.

The mounting seat 4 may be provided with a battery compartment 41, and the battery 61 may be mounted in the battery compartment 41, such that it has a compact structure, is easy to assemble and replace, and has good stability.

In the specific embodiment, the mounting seat 4 may be provided in the housing 111 of the pull-out head 11, such that the structure is more compact and smaller. The mounting seat 4 may be locked and fixed in the housing 111 by screws 112, which not only has good stability, but also is easy to disassemble and assemble, but not limited thereto. In some embodiments, the mounting seat 4 can also be fixed by other existing fixing methods, such as snap connection.

The acceleration sensor 5 may be electrically connected with the communication unit 7, and the communication unit 7 may be connected in communication with the communication unit of the control circuit board of the automatic water outlet control unit 2. The sensing signal of the acceleration sensor 5 may be transmitted to the control circuit board through the communication unit 7, and the control circuit board correspondingly controls the on-off state of the solenoid valve according to the received sensing signal, thereby controlling the on/off water of the pull-out head 11.

Preferably, in the specific embodiment, the acceleration sensor 5 is a three-axis acceleration sensor, such as the KMX63-1055 three-axis acceleration sensor produced by Kionix, which can sense the acceleration in all directions, and the use effect may be better, but not limited thereto. In some embodiments, the acceleration sensor 5 may also be implemented by using other existing acceleration sensors, such as a dual-axis acceleration sensor.

The mounting seat 4 may be provided with a first mounting cavity 42 with an opening, an opposite inner wall of the first mounting cavity 42 may be provided with a card slot 421, and the acceleration sensor 5 may be clamped in the card slot 421, such that it can be mounted in the first mounting cavity 42. The structure is simple, which is easy to assemble, but not limited thereto. In some embodiments, the acceleration sensor 5 can also be fixed in the first mounting cavity 42 by using other existing fixing structures.

Further, the first mounting cavity 42 may be sealed by pouring glue (not shown in the figures), such as pouring epoxy glue, to further improve the waterproof performance of the acceleration sensor 5, thereby improving safety, and reliability.

In the specific embodiment, the communication unit 7 may be a wireless communication unit 71, such as a 433 MHz wireless communication unit, a Bluetooth communication unit, a 2.4G communication unit, an infrared communication unit, a near-field wireless communication (NFC) unit, a WiFi communication unit, etc. The wiring is not needed, such that it has a simpler structure and is convenient for production, assembly, and subsequent maintenance, but not limited thereto. In some embodiments, the communication unit 7 may also be a wired communication unit.

Preferably, in the present embodiment, the wireless communication unit 71 may be fixed on the three-axis acceleration sensor 5, which has a simple structure and is easy to wire and assemble, but not limited thereto. In some embodiments, the wireless communication unit 71 can also be provided in other positions of the mounting seat 4.

The outgoing direction of the wireless signal of the wireless communication unit 71 is toward the direction of the water outlet panel 113 of the pull-out head 11. The water outlet panel 113 may be made of plastic material without being plated, so as to avoid shielding the wireless signal due to the housing 111 being a plated part, and improve the transmission distance and reliability.

In the specific embodiment, the sensing module may further include sensors 8, the mounting seat 4 may be provided with a second mounting cavity 43 with an opening, and the sensors 8 may be provided in the second mounting cavity 43. The sensors 8 may be electrically connected to the communication unit 7. The sensors 8 may be powered by the battery 61, and the sensing signal of the sensor 8 may be transmitted to the control circuit board through the communication unit 7, and the control circuit board correspondingly controls the on-off state of the solenoid valve according to the received sensing signal, thereby controlling the water on-off of the pull-out head 11, such that when the pull-out head 11 is not pulled out, the water can be turned on/off by sensing. The use functions are more abundant, and the user experience is improved.

Preferably, in the specific embodiment, each of the sensors 8 may be an infrared sensor, which is convenient to use, does not cause secondary pollution, and has low cost, but not limited thereto. In some embodiments, the sensor 8 can also be a microwave sensor, a capacitive sensor, a mechanical button sensor, etc.

Preferably, in the specific embodiment, the sensors 8 may include a first sensor 81 and a second sensor 82. The sensing direction of the first sensor 81 is toward the side of the pull-out head 11, correspondingly, a sensing window 811 is provided on the side wall of the housing 111 of the pull-out head 11. The sensing direction of the second sensor 82 may be toward the water outlet direction of the pull-out head 11, that is, outward the water outlet panel 113, such that water on-off can be sensed at the side and at a lower side. The use functions may be more abundant, and the user experience may be improved.

The first sensor 81 may include a circuit board 812, an infrared emitting tube 813, an infrared receiving tube 814, a light barrier 815, and a shell 816. The infrared emitting tube 813 and the infrared receiving tube 814 may be provided on the circuit board 812, and the light barrier 815 may be covered on the infrared emitting tube 813 and the infrared receiving tube 814. The shell 816 may be covered outside the light barrier 815. The light barrier 815 may be made of black opaque material, which separates the infrared emitting tube 813 and the infrared receiving tube 814, to avoid self-inductance and improve reliability. The structure of the second sensor 82 may be the same as that of the first sensor 81, and will not be described in detail here.

The mounting seat 4 may be made of materials that can transmit infrared light.

The working principle of the present disclosure:

The initial position before the pull-out head 11 is pulled out is denoted as the origin. When the pull-out head 11 is pulled out, the acceleration sensor 5 monitors the movement acceleration of the pull-out head 11 in the three directions of X, Y, and Z in the space, the collected acceleration data is transmitted to the control circuit board through the communication unit 7; then the control circuit board double-integrates the collected acceleration data, calculates the moving distance of the pull-out head in the three directions of X, Y, and Z; and then according to the position of the origin, the actual position of the pull-out head 11 at present is fitted. When the actual position of the pull-out head 11 is at the predetermined water outlet position, the control circuit board controls the solenoid valve to open, such that the pull-out head 11 discharges water. During the pull-out head 11 reset, after the pull-out head 11 moves out of the predetermined water outlet position, the control circuit board controls the solenoid valve to close, thereby controlling the pull-out head 11 to turn off the water, so as to control the pull-out head 11 to turn off the water. It can prevent the pull-out head 11 from turning on water as soon as it is pulled out, and turning off the water merely after the pull-out head 11 is reset, making it easy to scatter water everywhere, which affects the user experience and is not conducive to the problem of water saving. The convenience of use is good and the user experience is improved. In addition, the acceleration sensor 5, the power source 6, the communication unit 7, the first sensor 81, and the second sensor 82 may be all provided on the mounting seat 4 to form a whole module, which has a compact structure and is convenient for production, assembly, and subsequent maintenance.

Of course, in some embodiments, the faucet body 1 can also be a movable faucet.

The above descriptions are only preferred embodiments of the present disclosure, and are not intended to limit the design of the present disclosure. Any equivalent changes made according to the key design of the present disclosure fall into the protection scope of the present disclosure.

What is claimed is:

1. An acceleration sensor-based sensing faucet, comprising:

a faucet body;

an automatic water outlet control unit;

a sensing module; and a pull-out hose, wherein:

the faucet body has a movable water outlet end, the sensing module comprises a mounting seat, an acceleration sensor, a power source, and a communication unit, the acceleration sensor, the power source, and the communication unit are all provided on the mounting seat, the mounting seat is removably provided at the movable water outlet end, the power source supplies power to the acceleration sensor and the communication unit, the acceleration sensor is electrically connected to the communication unit, the communication unit is in communication with the automatic water outlet control unit, the automatic water outlet control unit is configured for controlling water outlet states of the movable water outlet end, the movable water outlet end is a pull-out head, the pull-out hose is movably provided in the faucet body, the pull-out head is connected with a water outlet end of the pull-out hose, a water inlet end of the pull-out hose is connected to a water outlet end of the automatic water outlet control unit, the mounting seat is provided with a first mounting cavity with an opening, an inner wall of the first mounting cavity is provided with a card slot, and the acceleration sensor is clipped in the card slot so as to be mounted in the first mounting cavity.

2. The acceleration sensor-based sensing faucet according to claim 1, wherein the acceleration sensor is a three-axis acceleration sensor.

3. The acceleration sensor-based sensing faucet according claim 2, wherein:

the communication unit is a wireless communication unit, the wireless communication unit is fixed on the acceleration sensor, an outgoing direction of a wireless signal emitted from the wireless communication unit is towards a direction of a water outlet panel of the pull-out head, and the water outlet panel is made of plastic material.

4. The acceleration sensor-based sensing faucet according to claim 1, wherein the first mounting cavity is sealed by gluing.

5. The acceleration sensor-based sensing faucet according claim 4, wherein:

the communication unit is a wireless communication unit, the wireless communication unit is fixed on the acceleration sensor, an outgoing direction of a wireless signal emitted from the wireless communication unit is towards a direction of a water outlet panel of the pull-out head, and the water outlet panel is made of plastic material.

6. The acceleration sensor-based sensing faucet according claim 1, wherein:

the communication unit is a wireless communication unit, the wireless communication unit is fixed on the acceleration sensor, an outgoing direction of a wireless signal emitted from the wireless communication unit is towards a direction of a water outlet panel of the pull-out head, and the water outlet panel is made of plastic material.

7. The acceleration sensor-based sensing faucet according to claim 1, wherein:

the power source is a battery, the mounting seat is provided with a battery compartment, and the battery is mounted in the battery compartment.

8. The acceleration sensor-based sensing faucet according to claim 1, wherein:

the sensing module further comprises sensors, the mounting seat is provided with a second mounting cavity with an opening, the sensors are provided in the second mounting cavity, the sensors are electrically connected with the communication unit, and the sensors are powered by the power source.

9. The acceleration sensor-based sensing faucet according to claim 8, wherein each of the sensors is an infrared sensor.

10. The acceleration sensor-based sensing faucet according to claim 9, wherein:

the sensors comprise a first sensor and a second sensor, a sensing direction of the first sensor is toward a side of the pull-out head, and a sensing direction of the second sensor is toward a water outlet direction of the pull-out head.

11. An acceleration sensor-based sensing faucet, comprising:

a faucet body;

an automatic water outlet control unit;

a sensing module; and a pull-out hose, wherein:

the faucet body has a movable water outlet end, the sensing module comprises a mounting seat, an acceleration sensor, a power source, and a communication unit, the acceleration sensor, the power source, and the communication unit are all provided on the mounting seat, the mounting seat is removably provided at the movable water outlet end, the power source supplies power to the acceleration sensor and the communication unit, the acceleration sensor is electrically connected to the communication unit, the communication unit is in communication with the automatic water outlet control unit, the automatic water outlet control unit is configured for controlling water outlet states of the movable water outlet end, the movable water outlet end is a pull-out head, the pull-out hose is movably provided in the faucet body, the pull-out head is connected with a water outlet end of the pull-out hose, a water inlet end of the pull-out hose is connected to a water outlet end of the automatic water outlet control unit, the sensing module further comprises sensors, the mounting seat is provided with a second mounting cavity with an opening, the sensors are provided in the second mounting cavity, the sensors are electrically connected with the communication unit, and the sensors are powered by the power source.

12. The acceleration sensor-based sensing faucet according to claim 11, wherein each of the sensors is an infrared sensor.

13. The acceleration sensor-based sensing faucet according to claim 12, wherein:

the sensors comprise a first sensor and a second sensor, a sensing direction of the first sensor is toward a side of the pull-out head, and a sensing direction of the second sensor is toward a water outlet direction of the pull-out head.

* * * * *